US006054926A

United States Patent [19]

Deleo

[11] Patent Number: 6,054,926

[45] Date of Patent: Apr. 25, 2000

[54] BABY MONITOR

[75] Inventor: James H. Deleo, Cape Coral, Fla.

[73] Assignee: James Deleo, Cape Coral, Fla.

[21] Appl. No.: 09/347,630

[22] Filed: Jul. 2, 1999

[51] Int. Cl.[7] ..... G08B 23/00

[52] U.S. Cl. ..... 340/573.1; 340/286.5; 340/573; 5/655; 455/128; 455/127; 367/197; 367/198; 367/199

[58] Field of Search ..... 340/573.1, 286.5, 340/573; 5/655; 455/128, 127; 367/197, 198, 199

[56] References Cited

U.S. PATENT DOCUMENTS

| | | | |
|---|---|---|---|
| 5,280,635 | 1/1994 | Knoedler et al. | 455/128 |
| 5,347,669 | 9/1994 | Neviaser et al. | 5/655 |
| 5,357,642 | 10/1994 | Clute | 5/655 |
| 5,757,274 | 5/1998 | Slomowitz et al. | 340/573 |
| 5,768,696 | 6/1998 | Law | 455/127 |
| 5,774,038 | 6/1998 | Welch et al. | 340/286.5 |

*Primary Examiner*—Jeffery A. Hofsass
*Assistant Examiner*—Tai T. Nguyen

[57] ABSTRACT

A baby monitor that monitors an infant while keeping the infant in a safe sleeping position that consists of infant positioning blocks incorporating a battery powered audio pickup with a low power FM transmitter. Infant positioning blocks are popularly known as baby wedges.

2 Claims, 3 Drawing Sheets

BABY MONITOR

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

The present invention is a means of monitoring an infant while keeping the infant in a safe sleeping position.

2. Description of Prior Art

Sudden Infant Death Syndrome, also known SIDS is a concern of every parent. Pediatricians recommend positioning an infant appropriately to minimize the risk. These recommended positions seem to vary with the pediatrician and seem to change over time. Infant positioning products, such as positioning blocks known as baby wedges exist. Also, constant monitoring of the infant is an additional safeguard against SIDS. Infant monitors exist, but the ones I've seen on the market are limited. Video monitors with sound are popular, but they are relatively expensive and do not convey adequate information when an infant is quiet and not moving. Video monitors are primarily effective when the infant is moving, or awake, or noisy. Existing audio monitors are popular, but are limited in that the ones I have seen marketed for this application transmit background noises such as humidifier noise or background radio that are confusing to the person trying to monitor the infant while in a different room. Baby positioning blocks such baby wedges exist to ensure the infant is sleeping in an approved position, either on their back or on their side, or whatever position is currently recommended by the family doctor. However, I did not find any baby wedges that incorporated a monitoring system such as does the present invention. I came up with the present invention because I could not find what I felt was needed to both monitor my infant and keep my infant in an appropriate sleeping position, as recommended by my family doctor. Prior to the present invention, existing inadequate means of monitoring a sleeping infant meant concerned parents needed to continually re-check the sleeping infant to be sure it was alright. As will be seen, the present invention addresses these and other problems. I couldn't find anything suitable, so I came up with my invention. To my knowledge, this is a unique product.

SUMMARY OF THE INVENTION

The present invention combines a means of audio monitoring a sleeping infant with a means of holding the sleeping infant in a recommended sleeping position.

DESCRIPTION OF THE PREFERRED EMBODIMENTS

Figure 1:
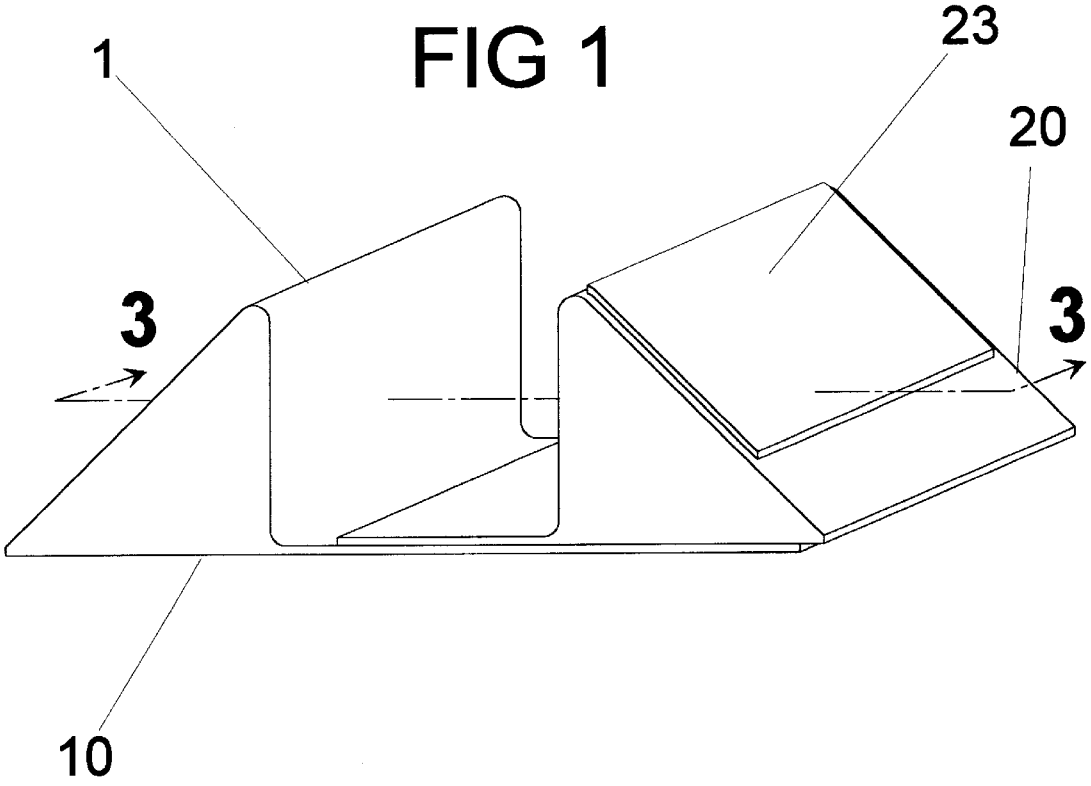
FIG. 1 shows the present invention.
Figure 2:
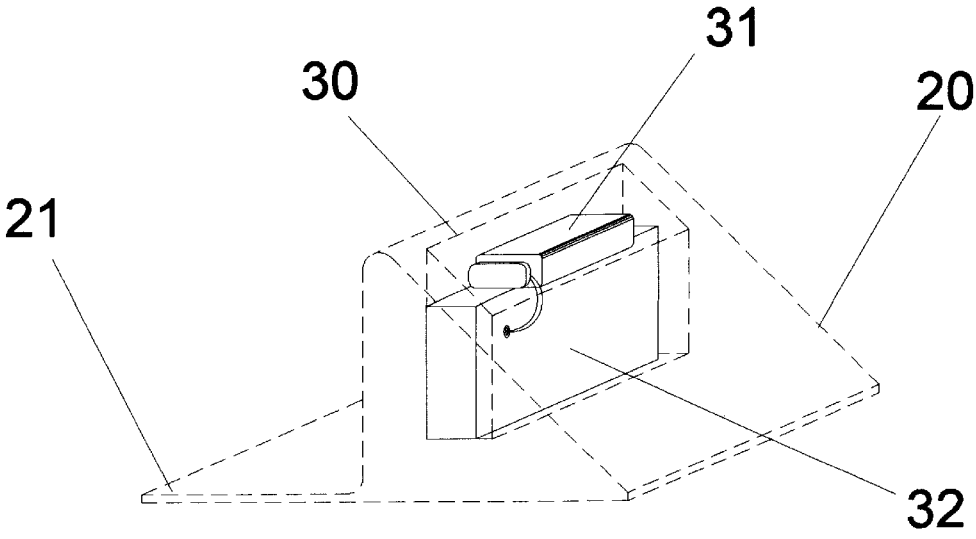
FIG. 2 shows some details of the present invention.
Figure 3:
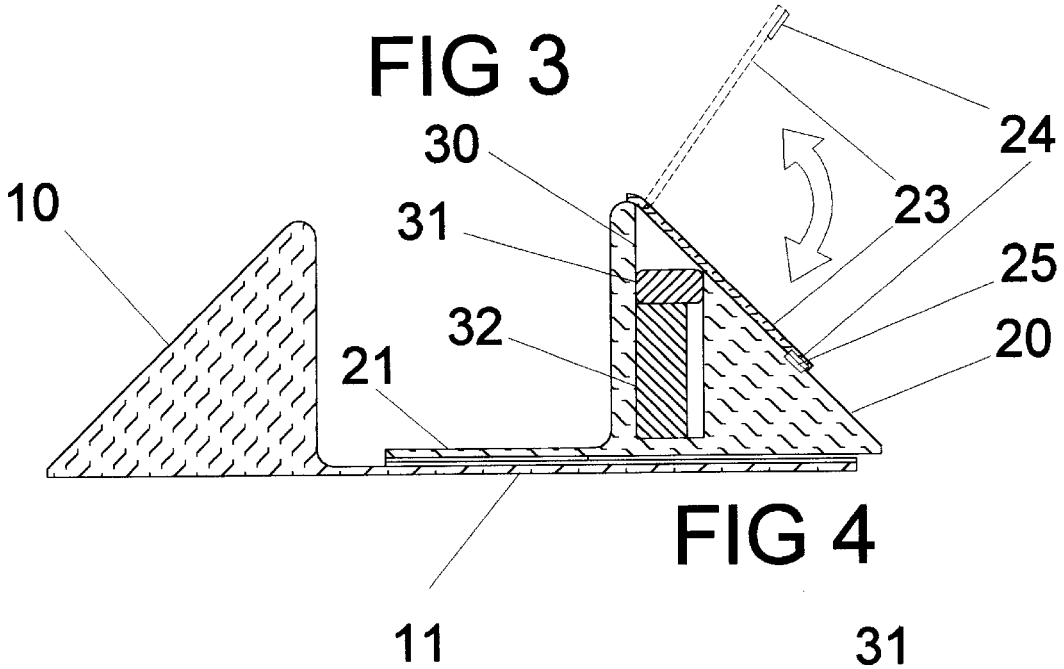
FIG. 3 shows a cross-sectional view of the present invention.
Figure 4:
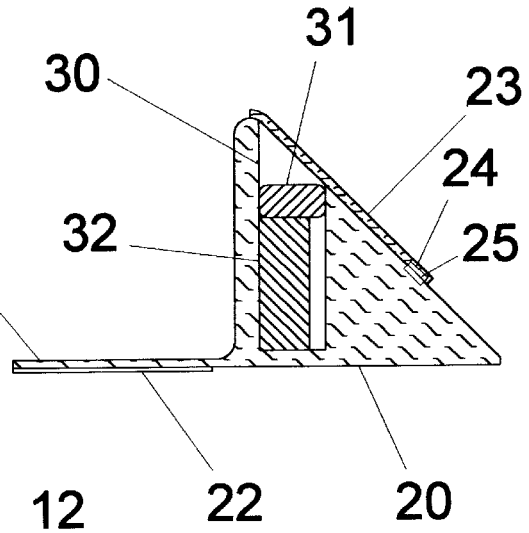
FIGS. 4 and 5 show additional details of the present invention.
Figure 5:
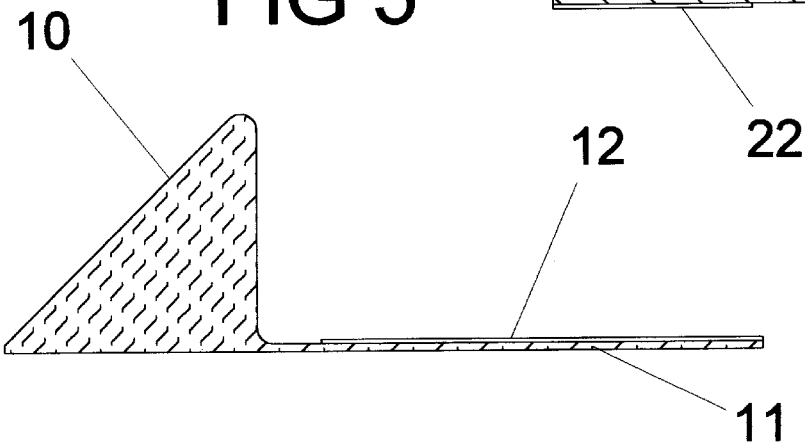

Referring to FIG. 1, the present invention, assembly 1 includes a left block 10 and a right block 20. As shown in FIGS. 1 and 2, the right block 20 has a cavity 30 and a cavity cover 23. Within the cavity 30 is contained a battery 31 which powers an audio pickup and low power transmitter 32. FIG. 3 is a cross-sectional view of the assembly 1. The cavity cover 23 is shown as movable from open to closed position. The cavity cover 23 is held closed by a hooks 24 and loops 25 construction known by the Trademark VELCRO. While the hooks 24 are shown as attached to the cavity cover 23 and the loops 25 are shown as attached to the right block 20, it is obvious that the hooks 24 and the loops 25 could be reversed. As shown in FIG. 5, the left block 10 includes a left block extension 11 which includes a hooks portion of the hooks and loops construction known by the Trademark VELCRO and labeled, for purposes of description, as the left block extension hooks 12. As shown in FIG. 4, the right block 20 includes a right block extension 21 which includes a loops portion of the hooks and loops construction known by the Trademark VELCRO and labeled, for purposes of description, as the right block extension loops 22. The left block extension hooks 12 when combined with the right block extension loops 22 hold the left block 10 and the right block 20 together, so as to hold an infant in place as shown in FIG. 6.

In the preferred embodiment of the present invention, the preferred material of construction for the left block 10 and the right block 20 is a medium density rigid cell foam plastic with a Terrycloth covering. The preferred material for the cavity cover 23 is a cardboard reinforced with thin foam liner and Terrycloth covering. The audio pickup and low power transmitter 32, in the preferred embodiment of the invention would be an audio pickup with an FM transmitter. The battery 31, in the prefered embodiment of the present invention would be a 9 volt battery. While an electric cord could be used, using household current, this does not seem desirable from a safety standpoint.

Figure 6:
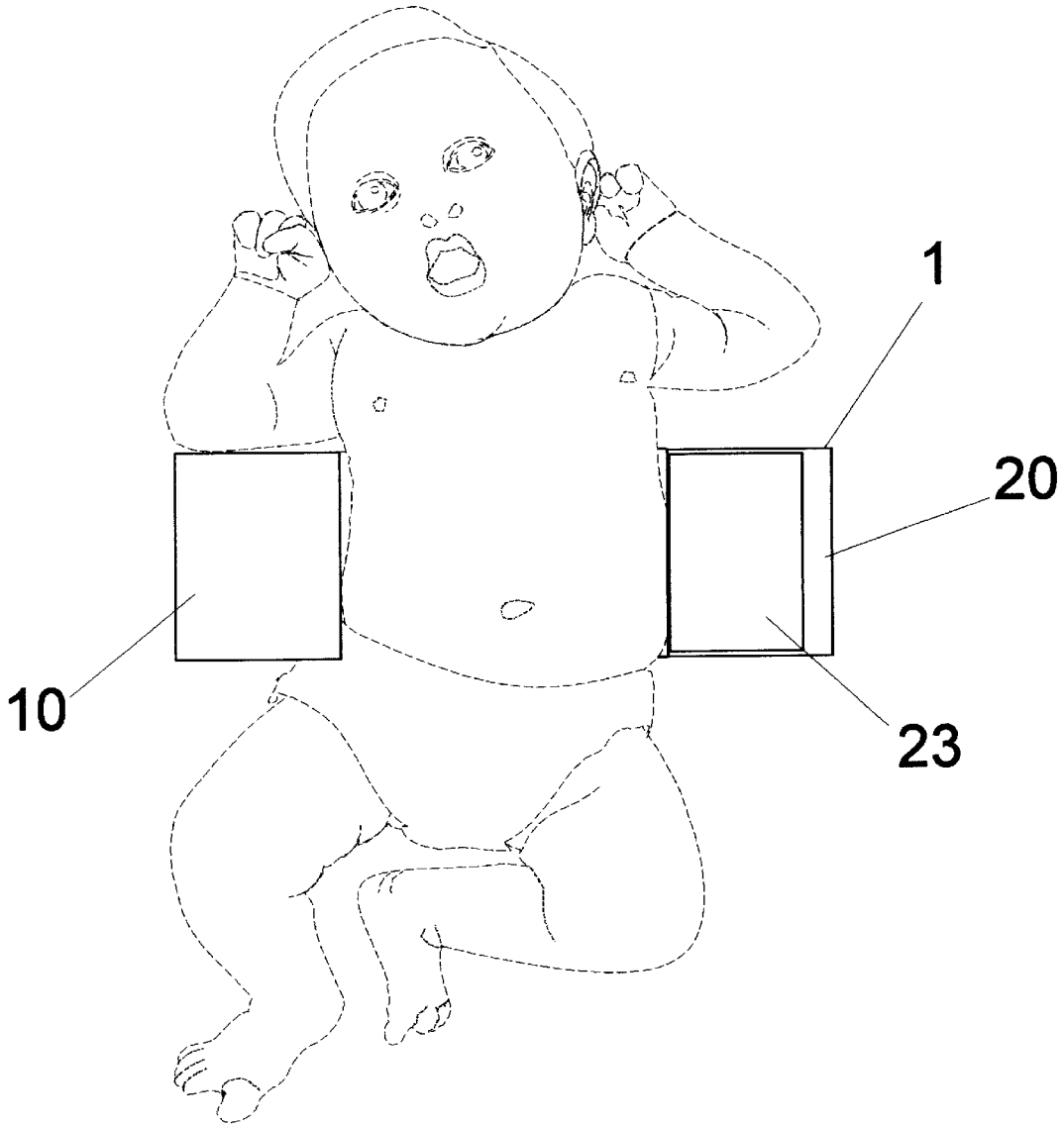
FIG. 6 shows the present invention in use.

FIG. 6 shows the present invention in use, where an infant is placed on its back with the present invention, assembly 1 surrounding the infant so that the infant's breathing, and perhaps even heartbeat can be monitored.

The present invention, assembly 1, is designed to hold a sleeping infant in a securely propped sleeping position, insuring that the infant cannot roll or become tangled in bedding, thereby limiting risk of death from SIDS or suffocation, and at the same time, monitor the infants breathing, movement noises, possibly heartbeat, and cries for help. While an infant monitor in itself is not inventive, the combination of the infant monitor with the assembly 1 so that the monitor is held closely to the infant so it can be more closely monitored is different from anything this inventor has seen on the market.

Although the description above contains many specificities, these should not be construed as limiting the scope of the invention but as merely providing illustrations of some of the presently preferred embodiments of this invention. For example, VELCRO is used to secure the cavity cover 23 to the block 30. Snaps or a zipper or some other means of fastening would suffice, although perhaps not as well.

Thus the scope of the invention should be determined by the appended claims and their legal equivalents, rather than by the examples given.

I claim:

1. A means of monitoring an infant while keeping the infant in a safe sleeping position, said means comprising blocks for restraining an infant, at least one of which contains an audio pickup with a transmitter, said blocks being adjustable with respect to each other so that a variable space exists between the blocks.

2. The means of claim 1 wherein the transmitter is a battery powered FM transmitter.

* * * * *